US011305150B2

(12) United States Patent
Lee et al.

(10) Patent No.: US 11,305,150 B2
(45) Date of Patent: Apr. 19, 2022

(54) SIMULATED HILL-CLIMBING EXERCISE APPARATUS

(71) Applicant: SUPERWEIGH ENTERPRISE CO., LTD., Nan-Tou Hsien (TW)

(72) Inventors: Sunny Lee, Tsao-Tun Chen (TW); Simon Chao, Tsao-Tun Chen (TW)

(73) Assignee: SUPERWEIGH ENTERPRISE CO., LTD., Tsao-Tun Chen (TW)

( * ) Notice: Subject to any disclaimer, the term of this patent is extended or adjusted under 35 U.S.C. 154(b) by 78 days.

(21) Appl. No.: 16/836,503

(22) Filed: Mar. 31, 2020

(65) Prior Publication Data

US 2021/0001167 A1 Jan. 7, 2021

(30) Foreign Application Priority Data

Jul. 1, 2019 (TW) ..... 108208515

(51) Int. Cl.

| | |
|---|---|
| ***A63B 22/00*** | (2006.01) |
| ***A63B 21/00*** | (2006.01) |
| ***A63B 21/005*** | (2006.01) |
| ***A63B 21/22*** | (2006.01) |

(52) U.S. Cl.

CPC ..... *A63B 22/0056* (2013.01); *A63B 21/0058* (2013.01); *A63B 21/00072* (2013.01); *A63B 21/22* (2013.01); *A63B 21/4034* (2015.10); *A63B 21/4035* (2015.10); *A63B 2022/0051* (2013.01)

(58) Field of Classification Search

CPC ..... A63B 22/0056; A63B 21/4034; A63B 21/4035; A63B 21/00072; A63B 21/0058; A63B 21/22; A63B 2022/0051; A63B 71/023; A63B 69/0048; A63B 2225/09; A63B 22/0046; A63B 21/00181; A63B 21/225; A63B 22/0005; A63B 22/001; A63B 2022/0043

See application file for complete search history.

(56) References Cited

U.S. PATENT DOCUMENTS

| | | | | |
|---|---|---|---|---|
| 6,648,800 | B2 * | 11/2003 | Stearns | A63B 22/001 482/52 |
| 9,050,485 | B2 * | 6/2015 | Huang | A63B 22/203 |
| 10,022,586 | B1 * | 7/2018 | Lee | A63B 22/0664 |
| 2005/0124467 | A1 * | 6/2005 | Rodgers | A63B 22/0017 482/52 |
| 2008/0070755 | A1 * | 3/2008 | McKee | A63B 22/0007 482/52 |
| 2010/0137111 | A1 * | 6/2010 | Van Handel | A63B 22/001 482/52 |
| 2012/0077645 | A1 * | 3/2012 | Lee | A63B 22/001 482/52 |
| 2019/0105530 | A1 * | 4/2019 | Tholkes | A63B 22/0056 |

* cited by examiner

*Primary Examiner* — Andrew S Lo
*Assistant Examiner* — Andrew M Kobylarz
(74) *Attorney, Agent, or Firm* — Burris Law, PLLC

(57) ABSTRACT

An exercise apparatus includes a support frame unit, a crank wheel unit disposed on the support frame unit, a resistance unit for providing resistance to the crank wheel unit, and two link units respectively disposed on left and right sides of the support frame unit. Each link unit includes a first pivot arm pivotally connected to the support frame unit, a pedal rod pivotally connected to the first pivot arm, a second pivot arm pivotally connected between the support frame unit and the pedal rod, a drive rod pivotally connected between the first pivot arm and the crank wheel unit, and a foot plate disposed on the pedal rod.

6 Claims, 11 Drawing Sheets

SIMULATED HILL-CLIMBING EXERCISE APPARATUS

CROSS-REFERENCE TO RELATED APPLICATION

This application claims priority from Taiwanese Utility Model Patent Application No. 108208515, filed on Jul. 1, 2019.

FIELD

The disclosure relates to an exercise apparatus, more particularly to an exercise apparatus that simulates a hill climbing exercise.

BACKGROUND

Referring to FIG. 1, an existing elliptical exercise apparatus includes a support frame unit 11, a crank wheel unit 12 pivotally connected to the support frame unit 11, two link rods 13 connected pivotally and respectively to left and right sides of the crank wheel unit 12, and two pedal rods 14 connected swingably and respectively to one ends of the link rods 13 that are opposite to the crank wheel unit 12. In use, the user's feet can step on the pedal rods 14 and travel along an elliptical path during exercise. However, the existing elliptical exercise apparatus can only simulate a normal walking gait.

SUMMARY

Therefore, an object of the present disclosure is to provide an exercise apparatus that can simulate a hill climbing exercise and that can increase training intensity.

According to this disclosure, an exercise apparatus that simulates a hill climbing exercise comprises a support frame unit, a crank wheel unit disposed on the support frame unit, a resistance unit for providing resistance to the crank wheel unit, and two link units respectively disposed on left and right sides of the support frame unit. Each link unit includes a first pivot arm pivotally connected to the support frame unit, a pedal rod pivotally connected to the first pivot arm, a second pivot arm pivotally connected between the support frame unit and the pedal rod, a drive rod pivotally connected between the first pivot arm and the crank wheel unit, and a foot plate disposed on the pedal rod. An extending direction of the first pivot arm and an extending direction of the second pivot arm form an included angle therebetween.

BRIEF DESCRIPTION OF THE DRAWINGS

Other features and advantages of the disclosure will become apparent in the following detailed description of the embodiments with reference to the accompanying drawings, in which.

DETAILED DESCRIPTION

Figure 1:
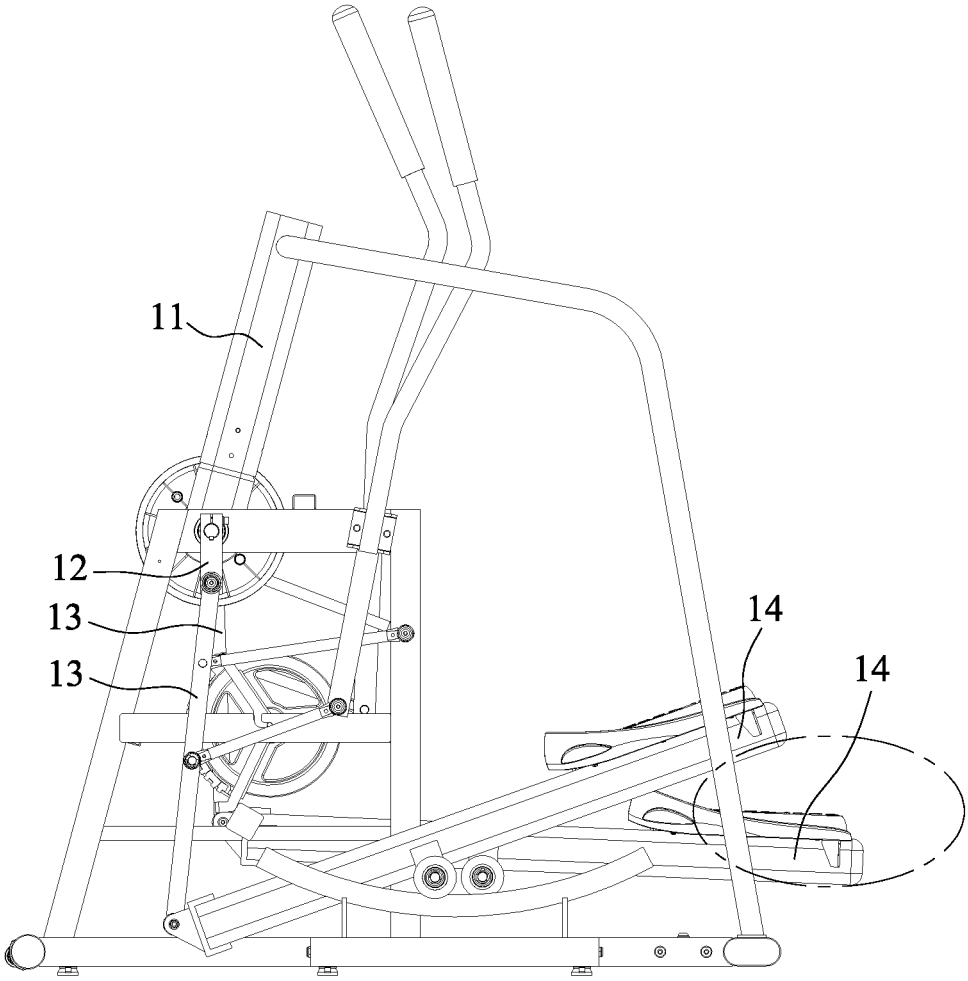
FIG.1 PRIOR ART
FIG. 1 is a side view of an existing elliptical exercise apparatus.

Before the present disclosure is described in greater detail, it should be noted herein that like elements are denoted by the same reference numerals throughout the disclosure.

Figure 2:
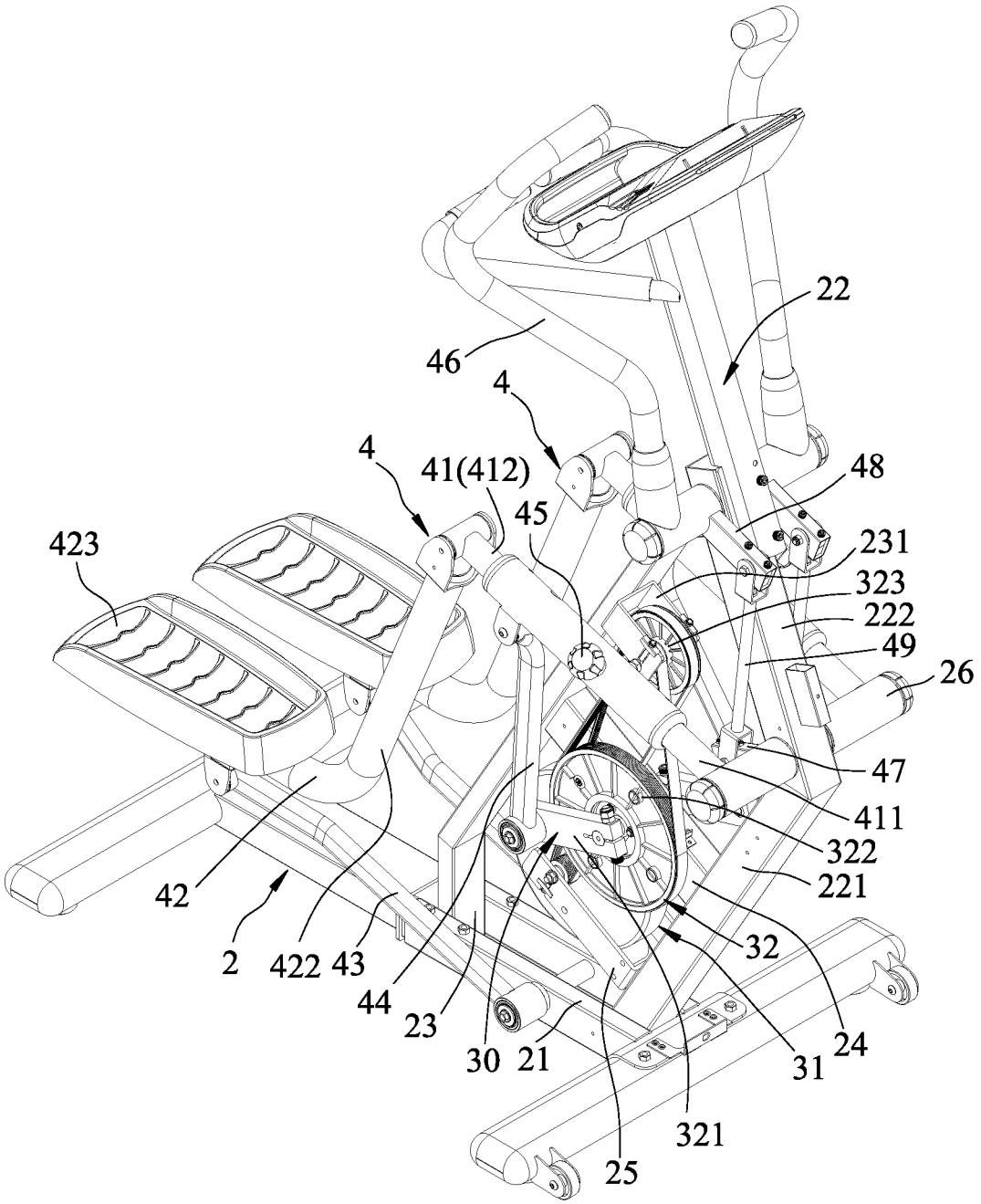
FIG. 2 is a perspective view of an exercise apparatus according to the first embodiment of the present disclosure.
Figure 3:
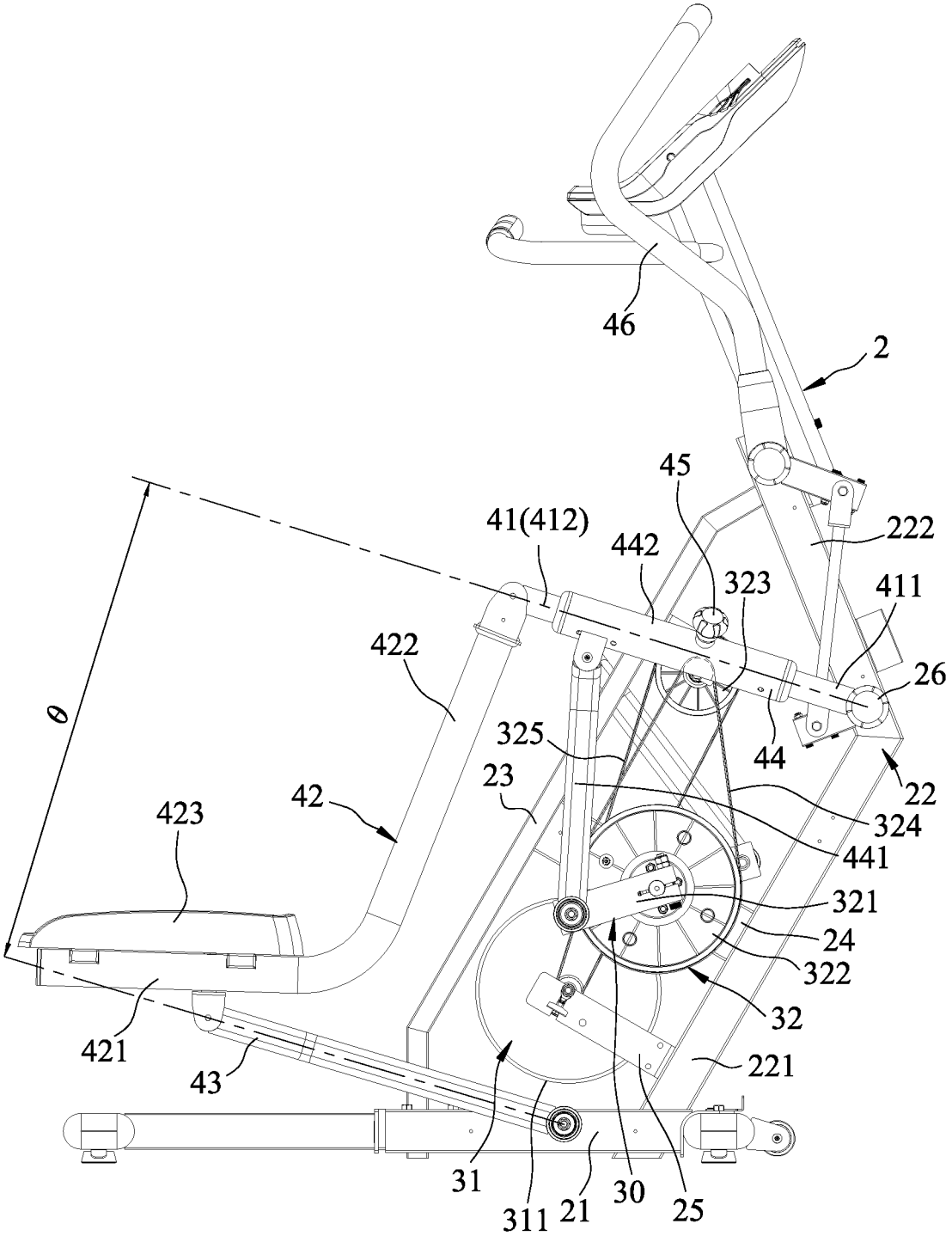
FIG. 3 is a side view of the first embodiment.
Figure 4:
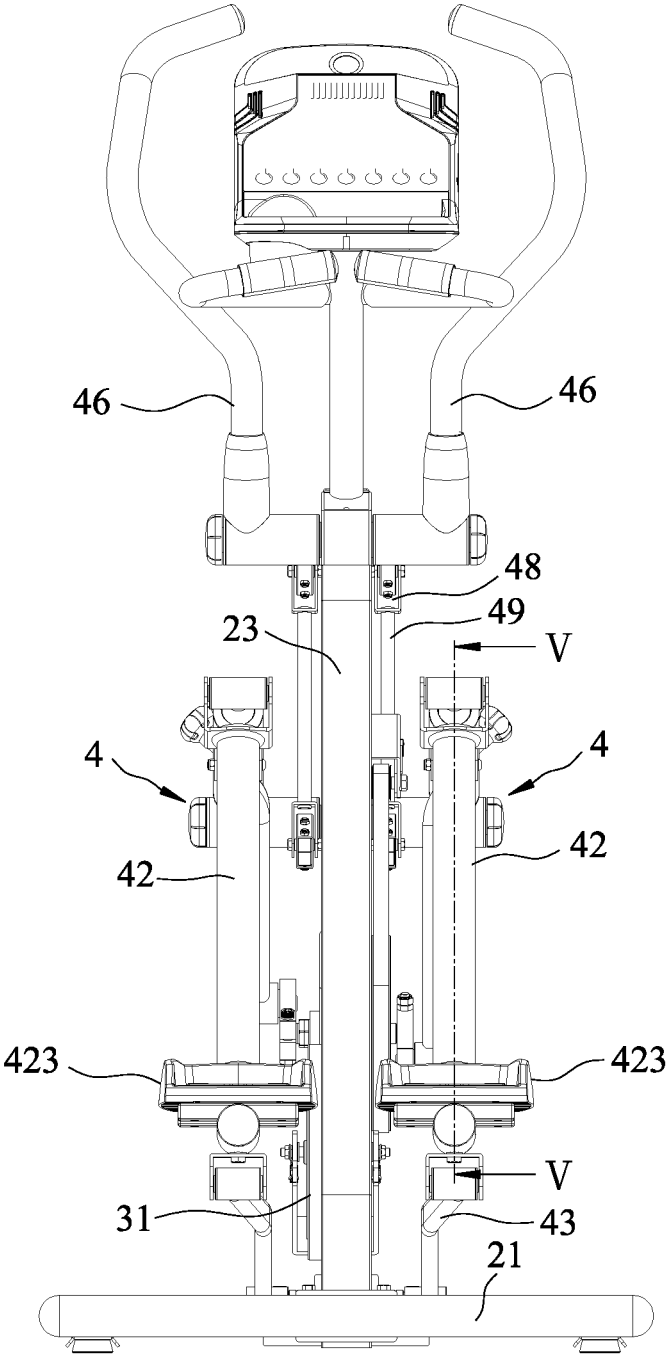
FIG. 4 is a rear view of the first embodiment.
Figure 5:
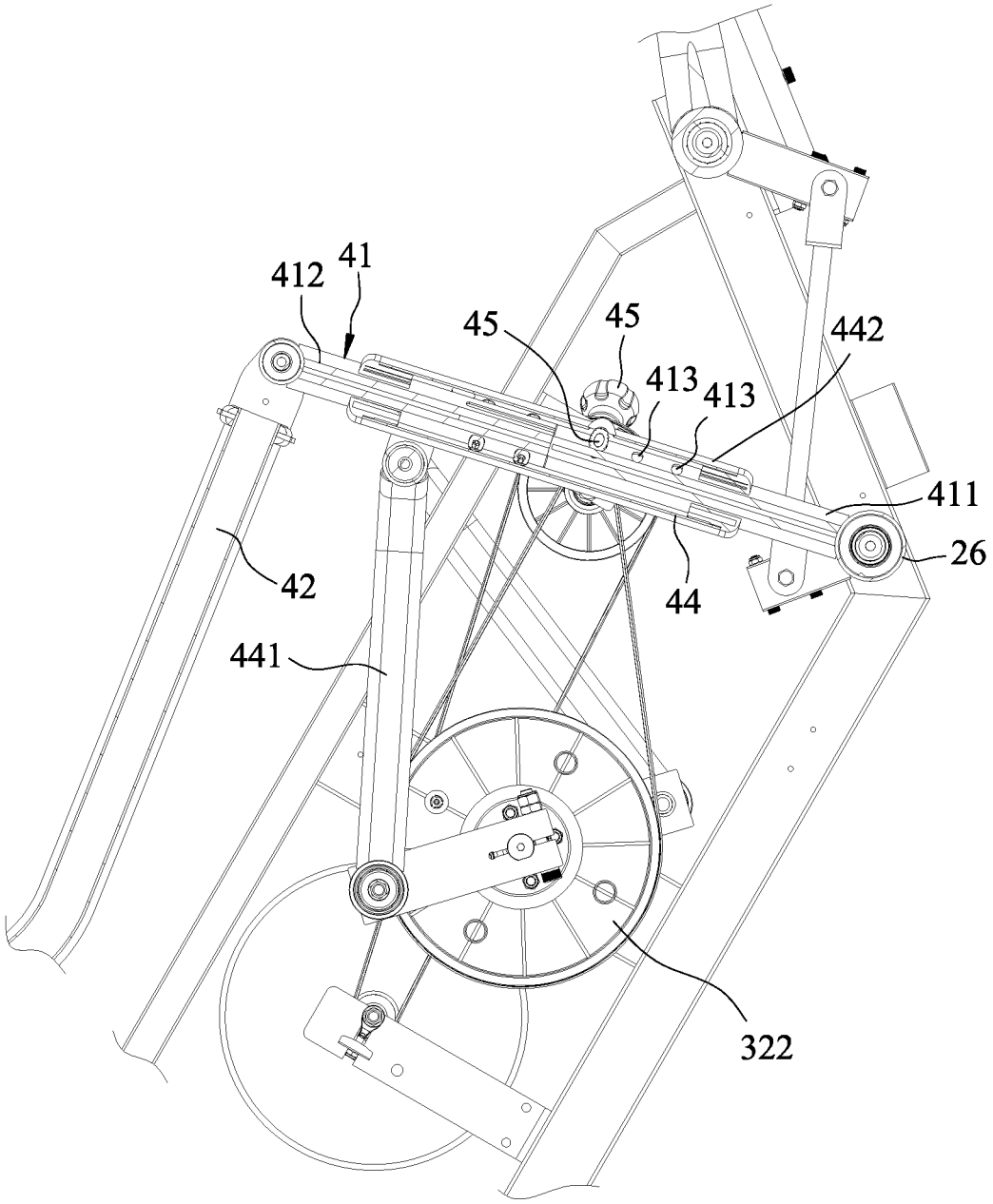
FIG. 5 is a sectional view of the first embodiment taken along line V-V of FIG. 4.
Figure 6:
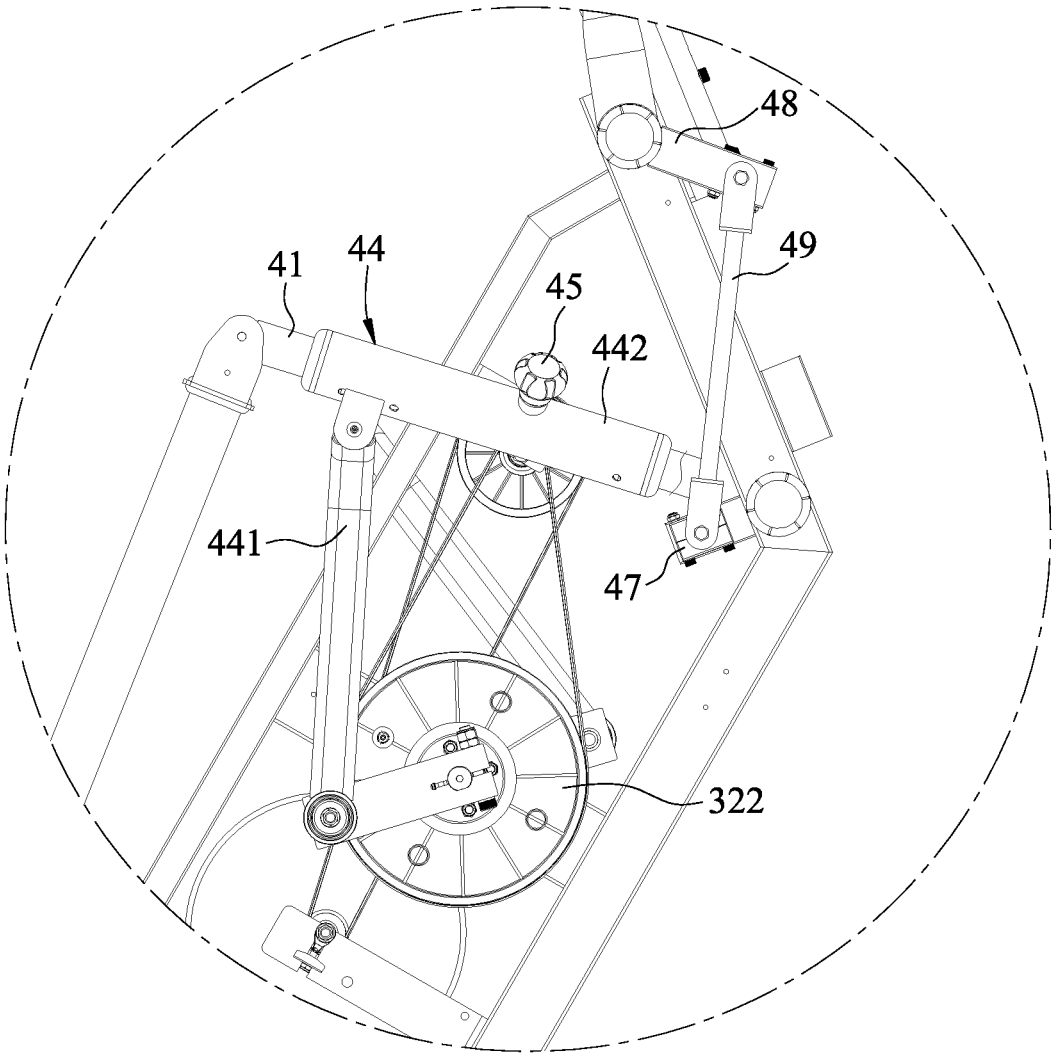
FIG. 6 is a fragmentary side view of the first embodiment.

Referring to FIGS. 2 to 4, an exercise apparatus according to the first embodiment of the present disclosure is configured to simulate a hill climbing exercise, and comprises a support frame unit 2, a crank wheel unit 30, a resistance unit 31, and two link units 4.

The support frame unit 2 includes a base frame 21, an upstanding frame 22, a support frame 23, a crank wheel support 24, a resistance wheel support 25, and a rotatable rod 26. The upstanding frame 22 includes a lower upstanding rod 221 extending upwardly, inclinedly and forwardly from the base frame 21, and an upper upstanding rod 222 extending upwardly, inclinedly and inwardly from a top end of the lower upstanding rod 221.

The support frame 23 is connected between the base frame 21 and a top portion of the upper upstanding rod 222, and has a pulley support 231. The crank wheel support 24 is connected between a middle portion of the lower upstanding rod 221 and the support frame 23, and is located below the pulley support 231, but above the base frame 21. The resistance wheel support 25 is connected to a bottom portion of the lower upstanding rod 221, and is located between the base frame 21 and the crank wheel support 24. The rotatable rod 26 is inserted transversely and rotatably through a bottom portion of the upper upstanding rod 222.

The crank wheel unit 30 includes a crank wheel 322 mounted rotatably on the crank wheel support 24, and two crank arms 321 connected rotatably and respectively to left and right sides of a crank shaft of the crank wheel 322.

The resistance unit 31 includes a resistance wheel 311 mounted rotatably on the resistance wheel support 25 to provide resistance to rotation of the crank wheel 322. A drive mechanism 32 is provided on the support frame unit 2, and includes a belt pulley 323 rotatably mounted on the pulley frame 231, a first belt 324 interconnecting the crank wheel 322 and the belt pulley 323, and a second belt 325 interconnecting the belt pulley 323 and the resistance wheel 311.

Referring to FIGS. 5 to 8, in combination with FIG. 3, the link units 4 are respectively disposed on left and right sides of the support frame unit 2. Since the structures of the link units 4 are similar, only one of the link units 4 will be described hereinafter.

The link unit 4 includes a first pivot arm 41, a pedal rod 42, a foot plate 423, a second pivot arm 43, a drive rod 44, a positioning member 45, a handle 46, a first link rod 47, a second link rod 48, and a transmission rod 49.

The first pivot arm 41 has a pivot end portion 411 fixed to the rotatable rod 26, a movable end portion 412 opposite to the pivot end portion 411, and a plurality of positioning holes 413 formed spaced apart along a length of the first pivot arm 41. The pedal rod 42 is substantially L-shaped, and includes a substantially horizontal rod portion 421, and a vertically inclined rod portion 422 extending upwardly, inclinedly and forwardly from a front end of the horizontal rod portion 421 and having a top end pivotally connected to the movable end portion 412 of the first pivot arm 41. The foot plate 423 is disposed on the horizontal rod portion 421, and is configured to form an angle with a horizontal plane. The angle formed by the foot plate 423 with the horizontal plane is changeable following a pivoting movement of the first pivot arm 41. The second pivot arm 43 is pivotally connected between the base frame 21 and the horizontal rod portion 421. The pivot end portion 411 of the first pivot arm 41 is fixed to the rotatable rod 26, so that the first pivot arm 41 is movable up and down relative to the upstanding frame 22.

Figure 7:
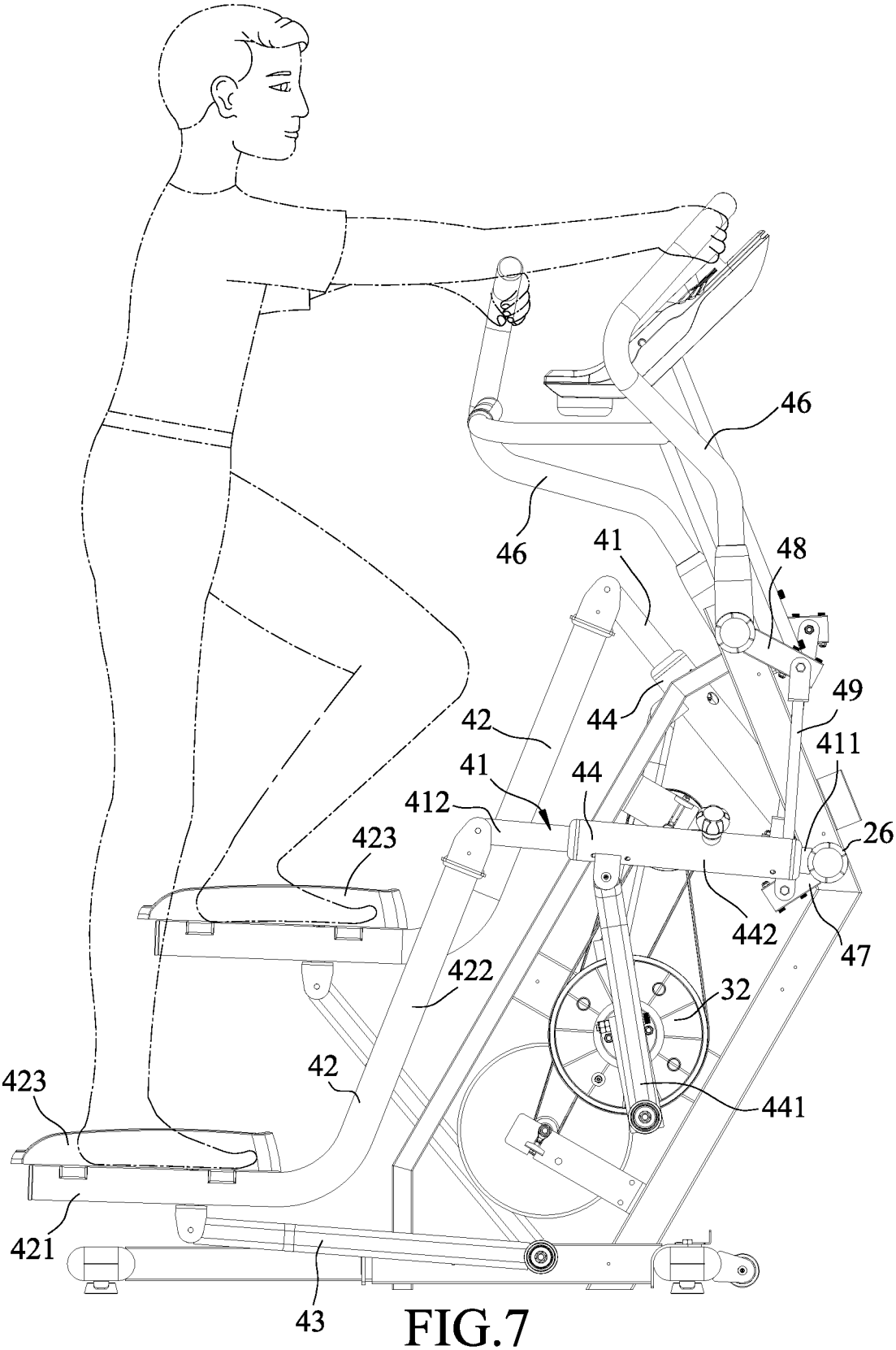
FIG. 7 is a side view of the first embodiment in a state of use.
Figure 8:
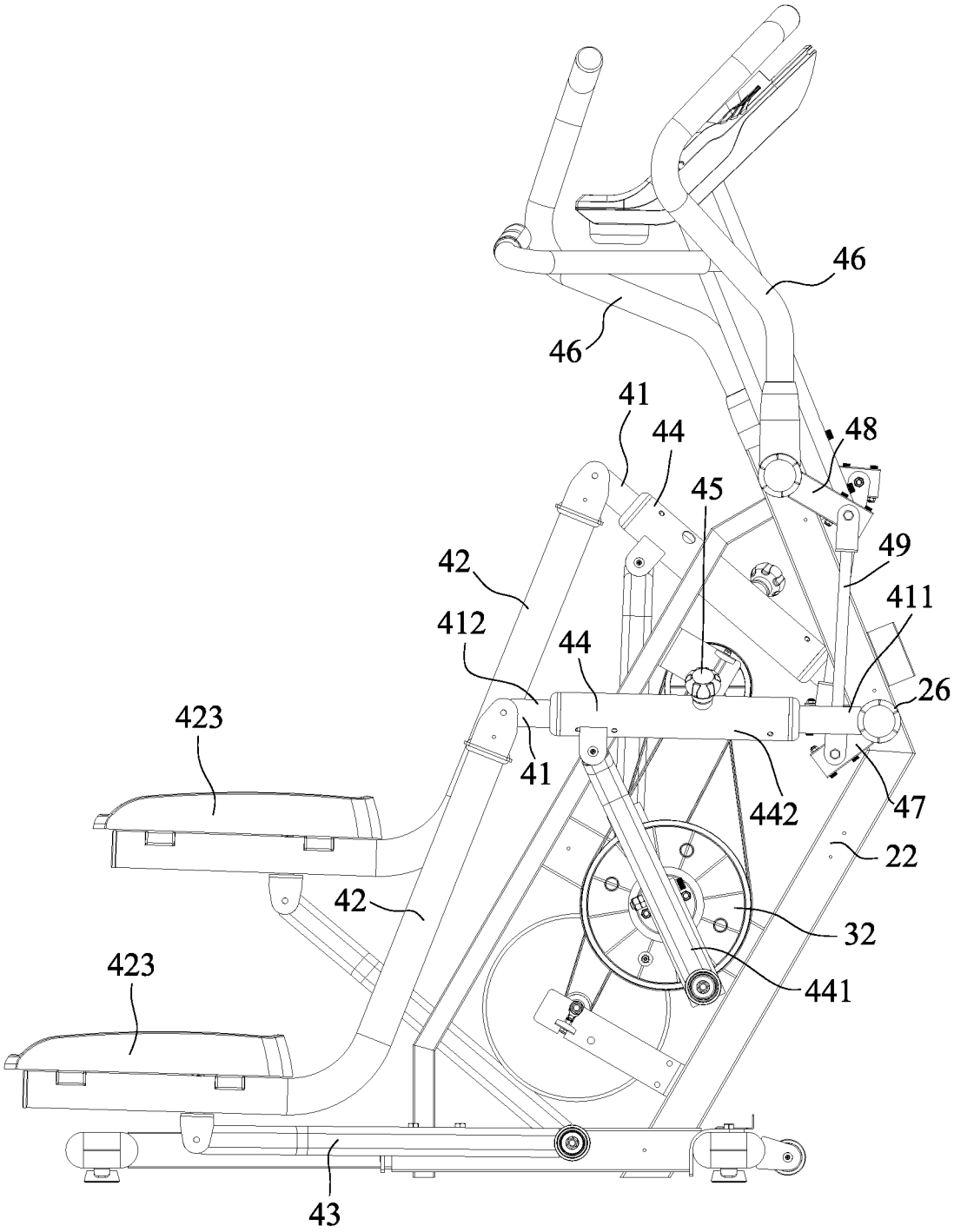
FIG. 8 is a view similar to FIG. 7, but illustrating a second rod section of a drive rod being close to a movable end portion of a first pivot arm.

The drive rod 44 includes a first rod section 441 having a lower end pivotally connected to one of the crank arms 321, and a second rod section 442 slidably sleeved on the first pivot arm 41 and having a rear end portion pivotally connected to an upper end of the first rod section 441. The second rod section 442 is slidable along the length of the first pivot arm 41 between a first position, as shown in FIG. 7, and a second position, as shown in FIG. 8. In the first position, the second rod section 442 is close to the pivot end portion 411 of the first pivot arm 41, and the movable end portion 412 of the first pivot arm 41 has a maximum pivoting amplitude. In the second position, the second rod section 442 is close to the movable end portion 412 of the first pivot arm 41, and the movable end portion 412 has a minimum pivoting amplitude.

Specifically, an extending direction of the first pivot arm 41 and an extending direction of the second pivot arm 43 form an included angle (θ), which is an acute angle, but is not limited thereto. Further, the pedal rod 42 may be a straight rod, but is not limited thereto.

The positioning member 45 of this embodiment is spring-loaded, but is not limited thereto. The positioning member 45 is selectively engaged to one of the positioning holes 413 in the first pivot arm 41. The handle 46 is pivotally connected to the upper upstanding rod 222, and is movable along with the first pivot arm 41. The first link rod 47 is fixed to the rotatable rod 26, and moves synchronously with the first pivot arm 41. The second link rod 48 is fixed to and moves synchronously with the handle 46. The transmission rod 49 is pivotally connected between the first and second link rods 47, 48.

Before use, a user first adjusts the position of the second rod section 442 of the drive rod 44 according to the user's leg lengths and the training requirements by pulling the positioning member 45 away from one of the positioning holes 413. The closer the second rod section 442 to the pivot end portion 411 of the first pivot arm 41, the larger the pivoting amplitude of the movable end portion 412 of the first pivot arm 41. After the desired position of the second rod section 442 is adjusted, the positioning member 45 is released from being pulled so as to engage with a selected one of the positioning holes 413. The desired position of the second rod section 442 is thus obtained.

In use, with reference to FIG. 7, when the user (shown in phantom lines) stands on the foot plates 423 with his hands grasping the handles 46, he can start the exercise by alternately stepping on the foot plates 423 in an upward and downward movement. At this time, the foot plates 423 drive the pedal rods 42 to move therealong; the pedal rods 42, in turn, drive the first pivot arms 41 to move therealong, and the first pivot arms 41 then drive the first rod sections 441 of the drive rods 44 to subsequently rotate the crank arms 321, the crank wheel 322, the pulley 323 and the resistance wheel 311. During the pivoting movement of each first pivot arm 41, the first link rod 47, the transmission rod 49, the second link rod 48, and the handle 46 are also sequentially moved.

In comparison with an existing simulated hill-climbing exercise apparatus in which an angle formed by each foot plate with the horizontal plane is fixed, because the first and second pivot arms 41, 43 of each link unit 4 of the present disclosure form the included angle (θ) therebetween, when the link units are actuated, the pedal rods 42 will drive the respective first pivot arms 41 to move therealong, and the angle between the foot plates 423 and the horizontal plane will change during the stepping movement of the user, thereby simulating the steps of climbing a hill. Thus, use of the exercise apparatus of this disclosure can achieve training of the foot muscles and enhance training intensity.

Moreover, by adjusting the positions of the second rod sections 442 of the drive rods 44, as shown in FIGS. 7 and 8, the pivoting amplitudes of the movable end portions 412 of the first pivot arms 41 can be adjusted, so that the stride lengths can also be adjusted during training to meet the various user's leg lengths and the training requirements without the need to purchase many exercise apparatuses with different stride lengths.

Figure 9:
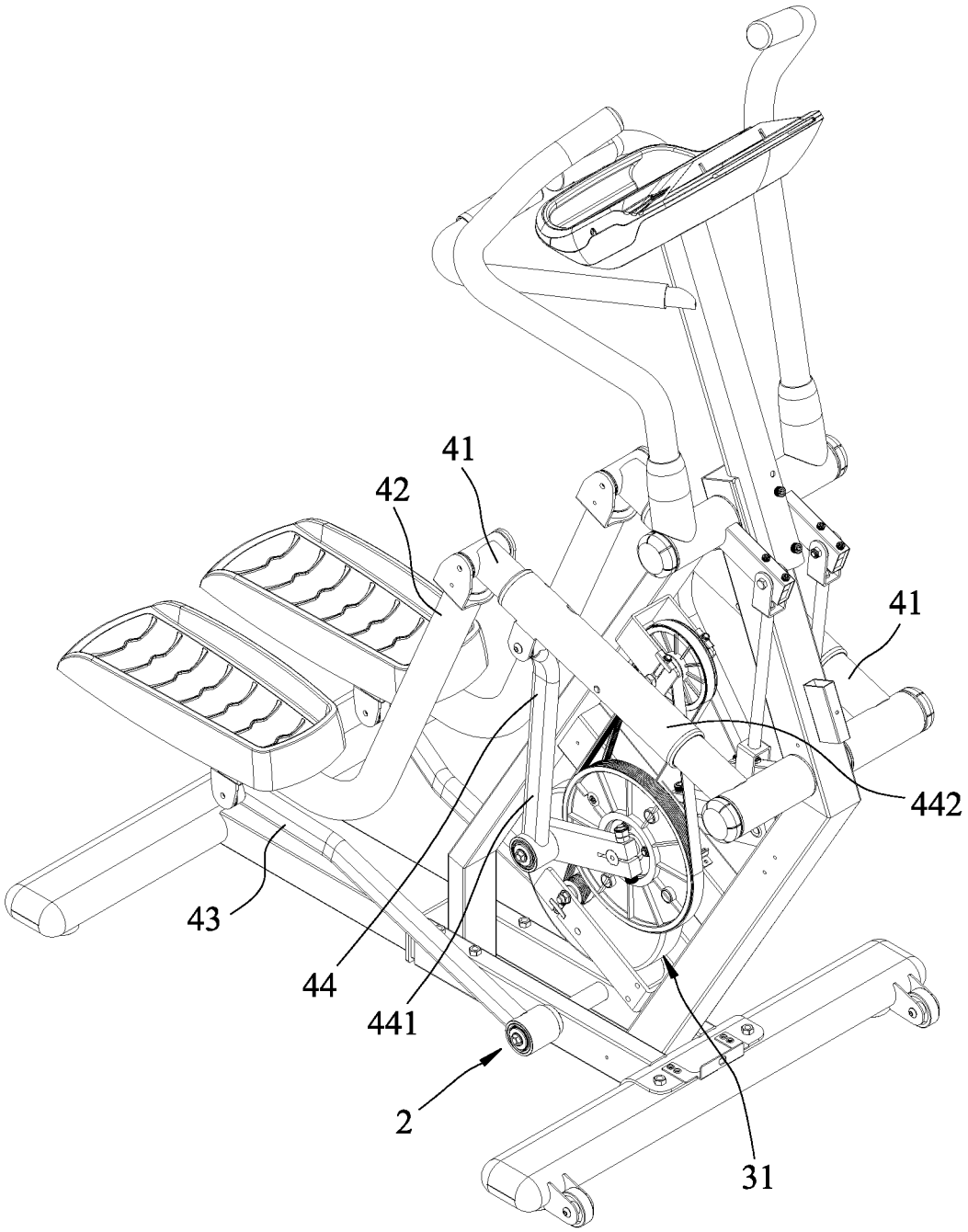
FIG. 9 is a perspective view of an exercise apparatus according to the second embodiment of the present disclosure.
Figure 10:
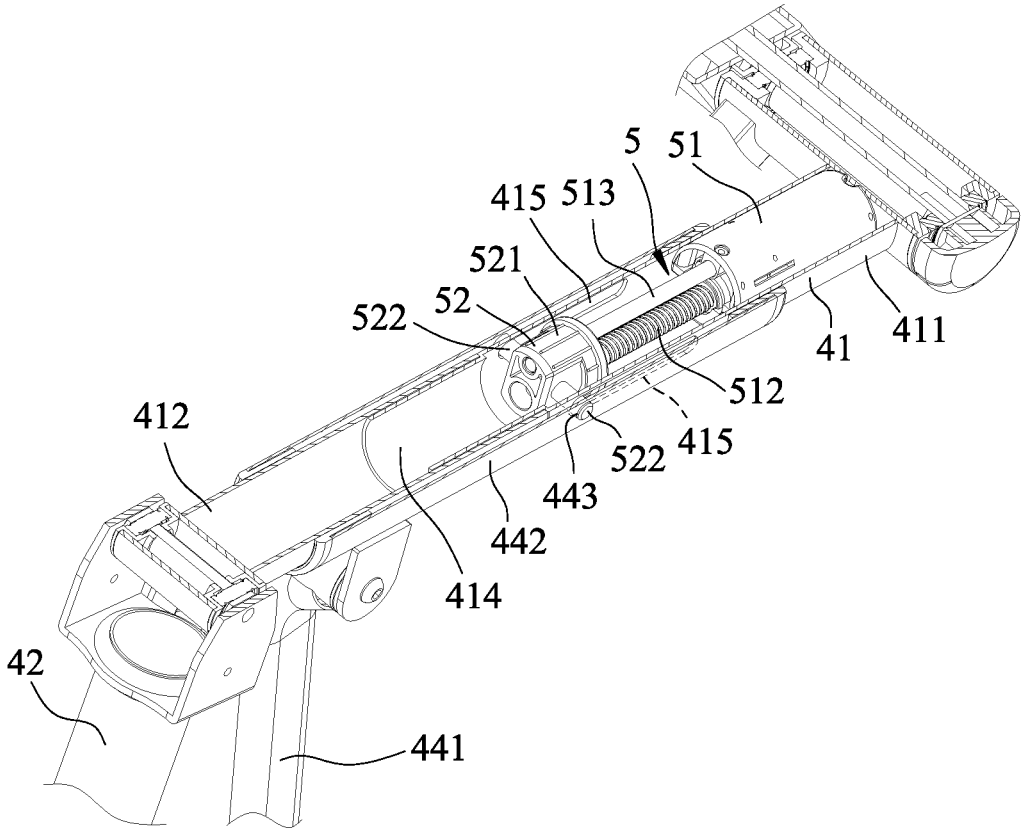
FIG. 10 is a fragmentary partially cutaway view of the second embodiment, illustrating a disposition of an adjustment unit.

Referring to FIGS. 9 and 10, the second embodiment of the exercise apparatus of this disclosure is substantially identical to the first embodiment. Particularly, the exercise apparatus comprises the support frame unit 2, the resistance unit 31, and the link units 4. The difference between the first and second embodiments resides in that, the exercise apparatus of the second embodiment further comprises an adjustment unit 5. The first pivot arm 41 defines an accommodation space 414, and has two guide slots 415 diametrically spaced apart from each other and communicating with the accommodation space 414. The second rod section 442 of the drive rod 44 has two diametrically spaced-apart through holes 443 (only one is visible in FIG. 10) respectively communicating with the guide slots 415. In other embodiment, the number of each of the guide slot 415 and the through hole 443 may be one, and is not limited to what is disclosed herein.

The adjustment unit 5 is disposed in the accommodation space 414, and includes an adjustment drive group 51 and an adjustment linkage group 52. The adjustment drive group 51 includes a motor 511 disposed in the accommodation space 414 at a position corresponding to the pivot end portion 411 of the first pivot arm 41, a threaded rod 512 connected to and driven by the motor 511 to rotate on its own axis and extending in a direction parallel to the length of the first pivot arm 41, and a guide rod 513 connected to the motor 511 and parallel to the threaded rod 512. The adjustment linkage group 52 has a movable member 521 connected to the threaded rod 512 and the guide rod 513, and two insertion pins 522 each of which extends transversely from the movable member 521 into a respective one of the through holes 443 through a corresponding one of the guide slots 415.

It is worth to mention herein that, in this embodiment, the adjustment drive group 51 is composed of the motor 511, the threaded rod 512 and the guide rod 513; and the movable member 521 is a threaded nut threadedly connected to the threaded rod 512. In other embodiments, other equivalent components that can move along a straight line, such as gears and racks, may also be used, and is not limited to what is disclosed herein.

Before use, the motor 511 is first activated to drive the movable member 521 to move threadedly along the length of the threaded rod 512. The insertion pins 522 move together with the movable member 521 and slide along the respective guide slots 415. Since the insertion pins 522 are fixedly inserted into the respective through holes 443, the second rod section 442 can be driven by the insertion pins 522 to move between the first position, in which the movable end portion 412 of the first pivot arm 41 has the maximum pivoting amplitude, and the second position, in which the movable end portion 412 of the first pivot arm 41 has the minimum pivoting amplitude. The user can adjust the position of the second rod section 442 according to the user's leg lengths and the training requirements prior to use of the exercise apparatus of this disclosure. Therefore, the second embodiment can achieve the same effect as that of the first embodiment, and can further improve the convenience of adjusting the pivoting amplitude of the movable end portion 412 of the first pivot arm 41.

Figure 11:
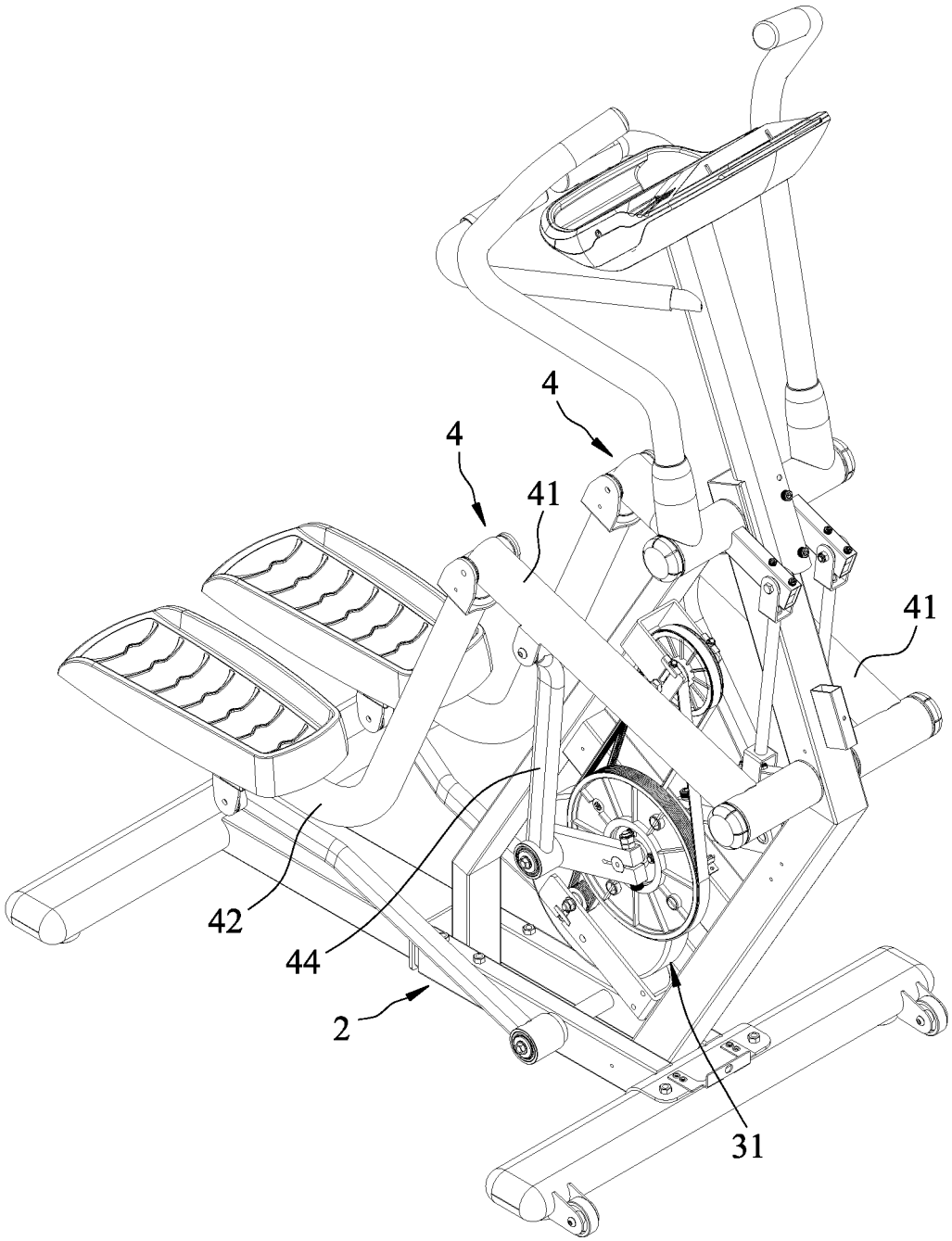
FIG. 11 is a perspective view of an exercise apparatus according to the third embodiment of the present disclosure.

Referring to FIG. 11, the third embodiment of the exercise apparatus of this disclosure is substantially identical to the first embodiment, and differs in that the drive rod 44 of the third embodiment does not have the second rod section 442, and the upper end of the first rod section 441 thereof is connected directly and pivotally to the first pivot arm 41. The third embodiment can achieve the same effect as that of the first embodiment.

Therefore, the object of this disclosure can indeed be realized.

In the description above, for the purposes of explanation, numerous specific details have been set forth in order to provide a thorough understanding of the embodiment (s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An exercise apparatus that simulates a hill climbing exercise, comprising:

a support frame unit;

a crank wheel unit disposed on said support frame unit;

a resistance unit for providing resistance to said crank wheel unit; and two link units respectively disposed on left and right sides of said support frame unit, each of said link units including a first pivot arm pivotally connected to said support frame unit, a pedal rod pivotally connected to said first pivot arm, a second pivot arm pivotally connected between said support frame unit and said pedal rod, a drive rod pivotally connected between said first pivot arm and said crank wheel unit, and a foot plate disposed on said pedal rod, an extending direction of said first pivot arm and an extending direction of said second pivot arm forming an included angle therebetween;

wherein each of said link units further includes a handle pivotally connected to said support frame unit and movable along with said first pivot arm; and wherein said support frame unit includes a base frame, an upstanding frame connected to said base frame, and a rotatable rod connected transversely and rotatably to said upstanding frame, said first pivot arm of each of said link units being fixed to said rotatable rod, each of said link units further including a first link rod fixed to said rotatable rod and moving synchronously with said first pivot arm, a second link rod fixed to and moving synchronously with said handle, and a transmission rod pivotally connected between said first and second link rods.

2. The exercise apparatus as claimed in claim 1, wherein said first pivot arm has a pivot end portion pivotally connected to said support frame unit, and a movable end portion opposite to said pivot end portion and pivotally connected to said pedal rod, said drive rod including a first rod section having one end pivotally connected to said crank wheel unit, and a second rod section pivotally connected to an opposite end of said first rod section and slidably sleeved on said first pivot arm, said second rod section being slidable on said first pivot arm between a first position, in which said second rod section is close to said pivot end portion and said movable end portion has a maximum pivoting amplitude, and a second position, in which said second rod section is close to said movable end portion and said movable end portion has a minimum pivoting amplitude.

3. The exercise apparatus as claimed in claim 2, wherein said first pivot arm further has a plurality of positioning holes formed spaced apart along a length thereof, each of said link units further including a positioning member disposed on said second rod section for selectively engaging one of said positioning holes.

4. The exercise apparatus as claimed in claim 1, wherein said pedal rod is substantially L-shaped.

5. An exercise apparatus that simulates a hill climbing exercise, comprising:

a support frame unit;

a crank wheel unit disposed on said support frame unit;

a resistance unit for providing resistance to said crank wheel unit; and two link units respectively disposed on left and right sides of said support frame unit, each of said link units including a first pivot arm pivotally connected to said support frame unit, a pedal rod pivotally connected to said first pivot arm, a second pivot arm pivotally connected between said support frame unit and said pedal rod, a drive rod pivotally connected between said first pivot arm and said crank wheel unit, and a foot plate disposed on said pedal rod, an extending direction of said first pivot arm and an extending direction of said second pivot arm forming an included angle therebetween;

wherein said first pivot arm has a pivot end portion pivotally connected to said support frame unit, and a movable end portion opposite to said pivot end portion and pivotally connected to said pedal rod, said drive rod including a first rod section having one end pivotally connected to said crank wheel unit, and a second rod section pivotally connected to an opposite end of said first rod section and slidably sleeved on said first pivot arm, said second rod section being slidable on said first pivot arm between a first position, in which said second rod section is close to said pivot end portion and said movable end portion has a maximum pivoting amplitude, and a second position, in which said second rod section is close to said movable end portion and said movable end portion has a minimum pivoting amplitude;

wherein said first pivot arm defines an accommodation space, and has at least one guide slot communicating with said accommodation space, said exercise apparatus further comprising an adjustment unit disposed in said accommodation space, and including an adjustment drive group, and an adjustment linkage group movably connected to said adjustment drive group; and wherein said adjustment drive group includes a motor disposed in said accommodation space at a position corresponding to said pivot end portion, and a threaded rod connected to and driven by said motor to rotate on its own axis and extending in a direction parallel to a length of said first pivot arm, said second rod section having at least one through hole communicating with said at least one guide slot, said adjustment linkage group including a movable member threadedly connected to said threaded rod, and at least one insertion pin extending transversely from said movable member and inserted into said at least one through hole through said at least one guide slot.

6. An exercise apparatus that simulates a hill climbing exercise, comprising:

a support frame unit;

a crank wheel unit disposed on said support frame unit;

a resistance unit for providing resistance to said crank wheel unit; and two link units respectively disposed on left and right sides of said support frame unit, each of said link units including a first pivot arm pivotally connected to said support frame unit, a pedal rod pivotally connected to said first pivot arm, a second pivot arm pivotally connected between said support frame unit and said pedal rod, a drive rod pivotally connected between said first pivot arm and said crank wheel unit, and a foot plate disposed on said pedal rod, an extending direction of said first pivot arm and an extending direction of said second pivot arm forming an included angle therebetween;

wherein said support frame unit includes a base frame, an upstanding frame connected to said base frame, and a support frame connected between said base frame and said upstanding frame; and wherein:

said upstanding frame includes a lower upstanding rod extending upwardly, inclinedly and forwardly from said base frame, and an upper upstanding rod extending upwardly, inclinedly and inwardly from a top end of said lower upstanding rod;

said support frame unit further includes a crank wheel support connected between said lower upstanding rod and said support frame and located above said base frame;

said support frame is connected between said base frame and said upper upstanding rod and has a pulley support located above said crank wheel support;

said crank wheel unit includes a crank wheel mounted rotatably on said crank wheel support, and two crank arms connected rotatably and respectively to left and right sides of a crank shaft of said crank wheel;

said support frame unit further includes a resistance wheel support connected to a bottom portion of said lower upstanding rod and located between said base frame and said crank wheel support;

said resistance unit includes a resistance wheel mounted rotatably on said resistance wheel support to provide resistance to rotation of said crank wheel; and said support frame unit further includes a drive mechanism, said drive mechanism including a belt pulley rotatably mounted on said pulley support, a first belt interconnecting said crank wheel and said belt pulley, and a second belt interconnecting said belt pulley and said resistance wheel.

* * * * *